US005265818A

United States Patent [19]

Nakasone

[11] Patent Number: 5,265,818

[45] Date of Patent: Nov. 30, 1993

[54] STRAP ROLLER HAVING SHAFT WITH ARCUATE PORTION AND TWO FLATTENED SIDES PARALLEL TO THE SHAFT AXIS

[76] Inventor: Cass K. Nakasone, 1028 17th Ave., Honolulu, Hi. 96816

[21] Appl. No.: 27,917

[22] Filed: Mar. 8, 1993

Related U.S. Application Data

[63] Continuation of Ser. No. 699,971, May 13, 1991, abandoned.

[51] Int. Cl.[5] ..... B65H 18/08; B65H 23/02

[52] U.S. Cl. ..... 242/67.1 R; 242/68.5; 242/75.2

[58] Field of Search ..... 242/67.1, 75.2, 60, 242/86.5 R, 86.52, 107.4 R, 107.4 C, 74, 71.8, 68.5

[56] References Cited

U.S. PATENT DOCUMENTS

| | | | |
|---|---|---|---|
| 506,913 | 10/1893 | Jobse | 242/60 |
| 742,163 | 10/1903 | Chadbourne et al. | 242/75.2 |
| 1,119,445 | 12/1914 | Murray et al. | 242/107.4 R |
| 1,142,039 | 6/1915 | Holcomb | 242/71.8 |
| 1,168,268 | 1/1916 | Addison | 242/74 |
| 1,359,021 | 11/1920 | Blair | 242/60 |
| 1,544,320 | 6/1925 | Hough | 242/75.2 |
| 1,977,103 | 10/1934 | Wise | 242/60 |
| 2,615,642 | 4/1950 | Schulz | 242/71.8 |
| 2,642,639 | 6/1953 | Meighan et al. | 242/71.8 X |
| 3,227,393 | 1/1966 | Misegadis | 242/86.5 R |
| 3,754,733 | 8/1973 | Foster | 242/96 X |
| 4,007,887 | 2/1977 | Vice | 242/86.5 R |
| 4,266,740 | 5/1981 | Ramos et al. | 242/86.5 R |
| 5,033,691 | 7/1991 | Tada et al. | 242/107.4 R |

FOREIGN PATENT DOCUMENTS

| | | | |
|---|---|---|---|
| 439797 | 12/1935 | United Kingdom | 242/60 |

*Primary Examiner*—Daniel P. Stodola
*Assistant Examiner*—John F. Rollins
*Attorney, Agent, or Firm*—Martin E. Hsia

[57] ABSTRACT

A strap rolling device comprising a shaft having at least one substantially flattened side and means for rotating the shaft. A strap tensioning device is preferably provided spaced apart from the shaft. The tensioning device includes a tensioner table with a groove, a tensioner bar configured to conform to the groove, and a spring for compressing the tensioner bar into the tensioner table. Optionally, a ratchet to allow rotation in only one direction and a mounting device can be provided.

18 Claims, 3 Drawing Sheets

STRAP ROLLER HAVING SHAFT WITH ARCUATE PORTION AND TWO FLATTENED SIDES PARALLEL TO THE SHAFT AXIS

This is a continuation of U.S. copending application Ser. No. 07/699,971 filed on May 13, 1991, now abandoned.

This invention relates to an device for rolling straps. The strap roller of this invention includes a tensioning device and provides for easy removal of the rolled strap. As used herein, straps shall include woven straps (such as elastic bandages), cloth straps and strips of any flexible material.

In many activities, such as weight lifting, it is necessary to repeatedly roll and reroll straps. It is also desirable to provide some tensioning during the rolling of a strap so that the strap can be rolled into a relatively compact bundle and so that the strap can be applied with a relatively constant tension. In weight lifting, it is also desirable to roll straps relatively quickly and easily so that a minimum of time is wasted between sets of weight lifting.

Many strap rollers are known.

U.S. Pat. No. 3,516,618 to Reinke discloses a bandage winder having a rotating winding fork powered by an electric motor with a strap tensioner spaced apart from the winding fork.

U.S. Pat. No. 537,507 to Waldron discloses another bandage winder having a spindle that is bifurcated to receive the end of a bandage.

U.S. Pat. No. 3,998,402 to Christensen discloses a device for winding strips of sheet material into tubes employing spindles that are split along their length.

U.S. Pat. No. 742,163 to Chadbourne et al. discloses a tension regulating device consisting of a plate located in a groove and having a spiral compression spring and adjusting screw whereby tightening the screw increases compression of the plate in the groove.

U.S. Pat. No. 1,445,022 to Kimball discloses a tensioning device including two flat plates compressed together by springs.

U.S. Pat. No. 1,965,567 discloses a tensioning device including complementary fluted blocks.

U.S. Pat. No. 2,144,264 to McRae discloses a tensioning device including a shoe that rides upon a surface of a ribbon and extends through a loop frame.

A problem with these and other devices is that they require a split spindle or shaft for initial rolling of the strap, which increases the cost of manufacture and decreases strength and durability of the spindle or shaft. Some of the devices are also mechanically complex and difficult to manufacture. A further disadvantage of a split spindle is that removing the rolled strap becomes difficult, perhaps because the tension applied during rolling squeezes the two sides of the split spindle together, thereby retaining the inserted end of the strap in the spindle.

It is therefore an object of this invention to provide a sturdy mechanically simple device that rolls straps.

It is a still further object of this invention to provide such a device that can apply tension to such straps as they are being rolled.

It is a still further object of this invention to provide such a device that does not require a split spindle or shaft for initiating the rolling process.

It is a still further object of this invention to provide such a device that is easy to load and unload and does not require threading of the end of a strap of material through a slot in a spindle.

It is a still further object of this invention to provide such a device that does not allow rolled straps to unravel.

SUMMARY OF THE INVENTION

These and other objects are obtained by a strap rolling device including a shaft with at least one substantially flattened side and means for rotating the shaft. Preferably, the shaft is provided with two substantially flattened sides that are approximately perpendicular. Unexpectedly, this configuration of the shaft allows a strap to be retained on the shaft by initially wrapping the strap around the shaft slightly more than once. The strap can then be rolled under tension thereafter.

Tension for the strap is preferably provided by a strap tensioner that is spaced apart from the shaft. Although the strap tensioner can be of any conventional design, it is preferred that the strap tensioner include a tensioner bar configured to conform to a complementary groove with variable compression means for variably compressing the tensioner bar into the groove. Preferably, this variable compression means comprises a combination of a tension adjustment screw and springs, as more particularly described below. Optionally, the tensioner can be provided with alignment bars and the entire device can be provided with an attachment means, including a clamp.

DETAILED DESCRIPTION OF THE PREFERRED EMBODIMENT

Figure 1:
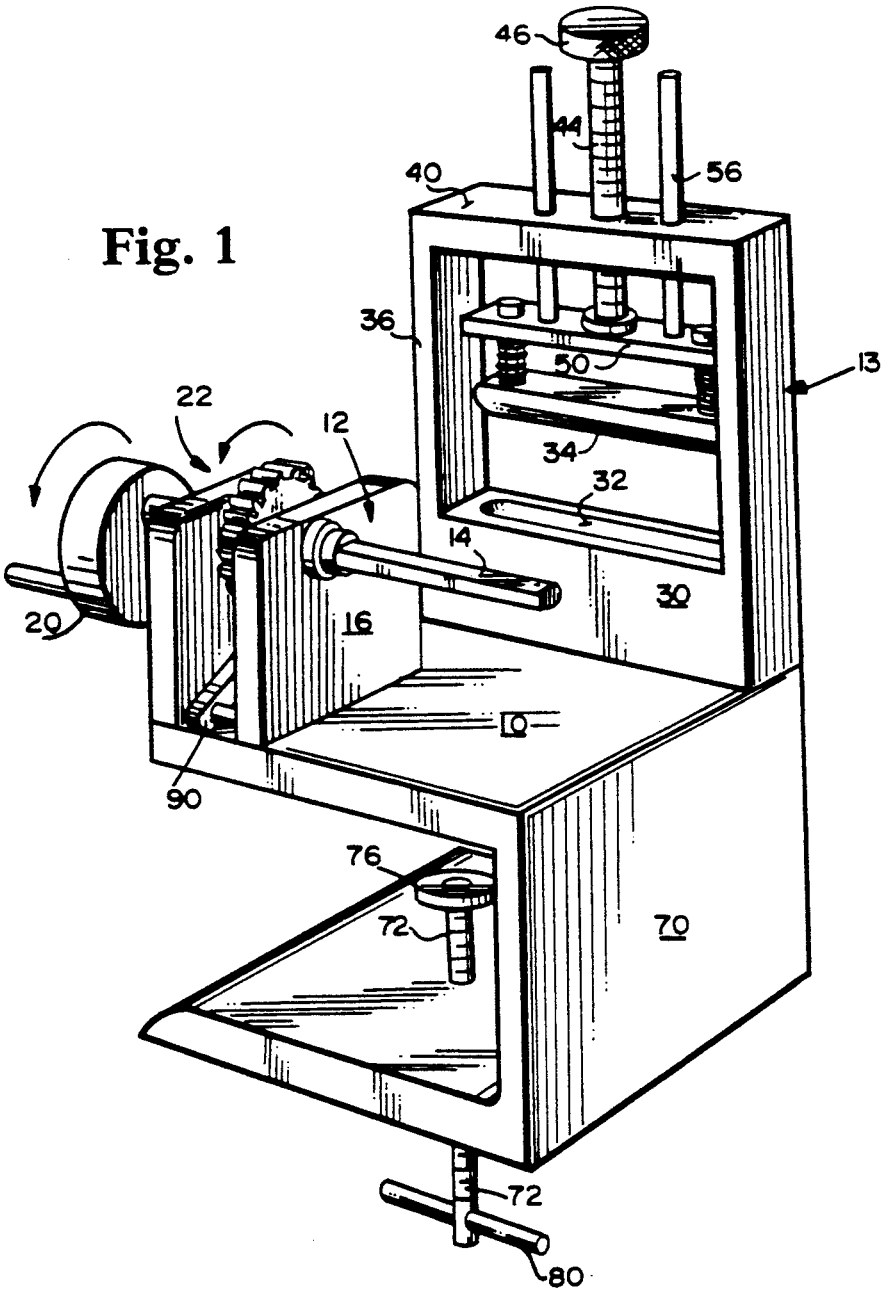
FIG. 1 is a perspective view of a preferred embodiment of this invention.

Referring to FIG. 1, the preferred embodiment comprises a main frame 10 on which a shaft assembly 12 and a strap tensioner 13 are mounted.

The shaft assembly comprises a shaft 14, preferably substantially flattened on two perpendicular sides, which is supported above the main frame 10 by a shaft support member 16. The shaft 14 must be spaced sufficiently far from the main frame 10 to accommodate a completely rolled strap.

Figure 7:
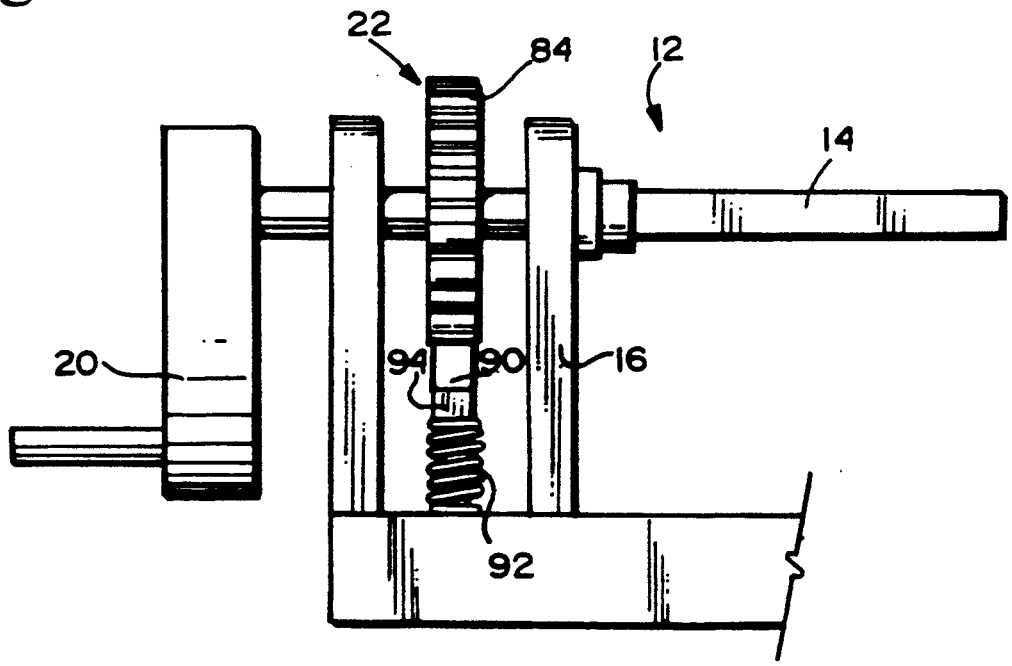
FIG. 7 is a front elevational view of the shaft assembly of FIG. 1.

As can be seen more clearly from FIG. 7, the shaft assembly comprises a crank 20 of conventional design driving the shaft 14, with a ratchet assembly 22 allowing rotation of the shaft 14 in only one direction.

Figure 2:
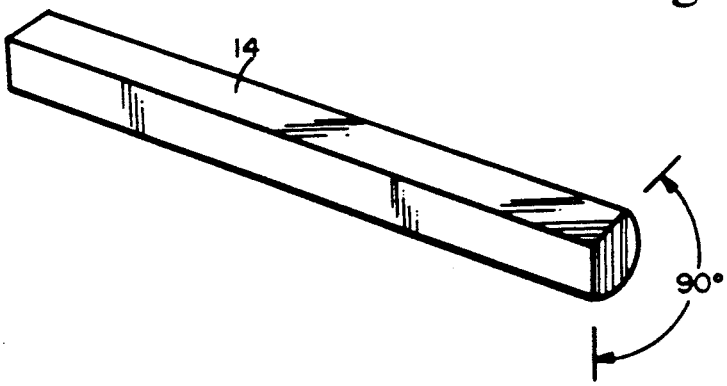
FIG. 2 is a close-up perspective view of a bevelled shaft in accordance with a preferred embodiment of this invention.

FIG. 2 shows a close-up perspective view of the preferred double bevelled shaft of the invention, showing the preferred approximately perpendicular angle between the two bevelled faces.

Figure 3:
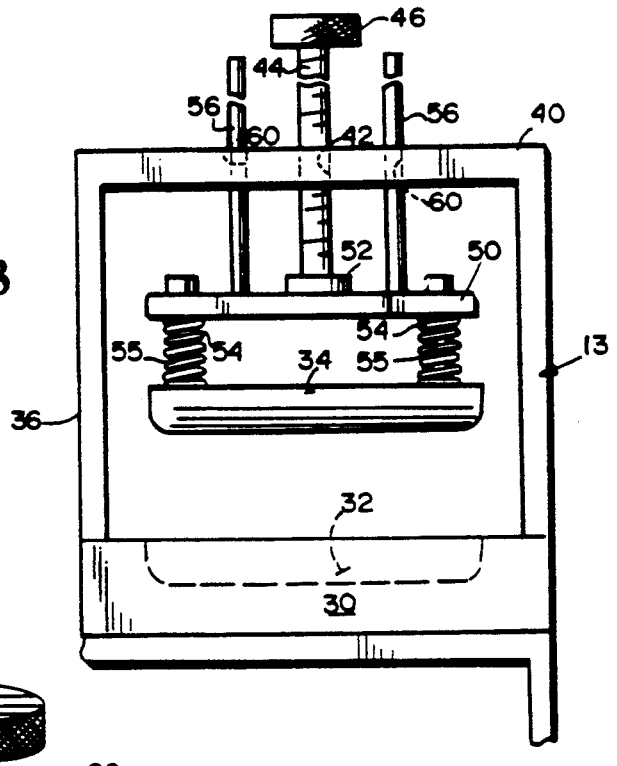
FIG. 3 is a front elevational view of the strap tensioner of FIG. 1.

FIG. 3 shows the preferred embodiment of the strap tensioner 13, which includes a tensioner table 30 having a groove 32 formed therein, with a tensioner bar 34 configured to conform to the groove 32 supported above the groove 32. The tensioner bar is supported by a tensioner frame 36 attached to the tensioner table 30, which includes a tensioner top 40 having a threaded screw aperture 42. A tension adjustment screw 44 is passed through the screw aperture 42 and preferably is provided with a large knurled knob 46 for manipulation. The tension adjustment screw 44 is preferably attached to an alignment bar 50 through a flange 52 and the alignment bar 50 is preferably attached to the tensioner bar by two tensioner springs 54. The springs 54 are preferably maintained in place by spring shafts 55. Preferably two alignment rods 56 are attached to the alignment bar 50 and extend through two alignment apertures 60 in the tensioner top 40 to maintain the alignment bar 50 and therefore the tensioner bar 34 in alignment with the tensioner top 40.

Figure 4:
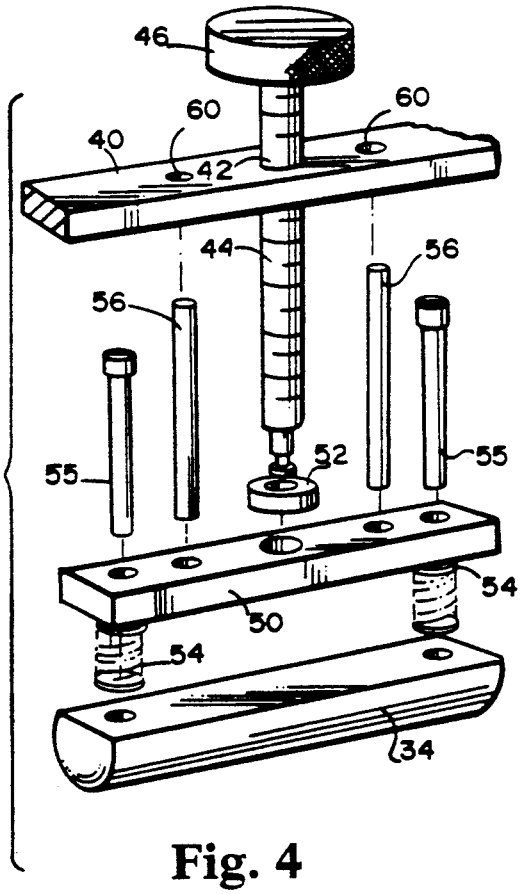
FIG. 4 is an exploded view of the strap tensioner of FIG. 3.

FIG. 4 shows an exploded view of the various parts of the preferred tensioner.

Figure 5:
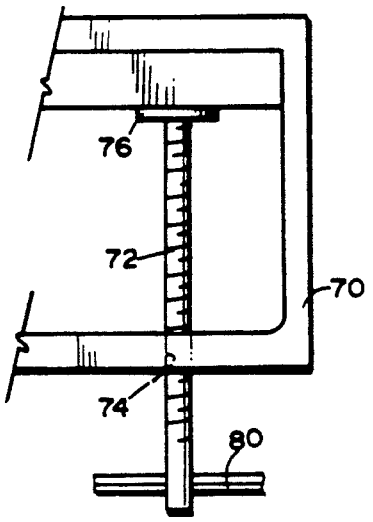
FIG. 5 is a front elevational view of the clamp of FIG. 1.

FIG. 5 shows the preferred means for attaching the main frame 10 to a surface using a clamp body 70 attached to the main frame 10 (see FIG. 1) with a clamp screw 72 passing through a threaded clamp aperture 74 in the clamp body 70. Preferably the clamp screw 72 is provided at one end with a contact member 76 and at the other end with a clamp bar 80 for manually rotating the clamp screw 72.

Figure 6:
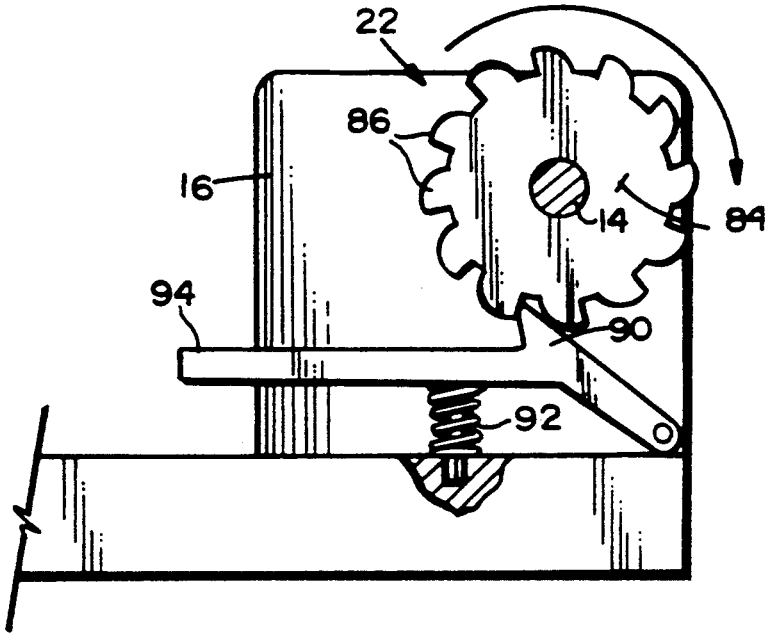
FIG. 6 is a side elevational view of the ratchet mechanism of FIG. 1.

FIG. 6 shows the ratchet for the preferred embodiment of FIG. 1. The shaft 14 causes a ratchet wheel 84 provided with teeth 86 to rotate. A pawl 90 is urged into contact with the ratchet teeth 86 by a pawl spring 92. The pawl 90 can be selectively disengaged from the ratchet teeth 86 by pressing on a pawl bar 94.

FIG. 7 shows the preferred means for causing the shaft 14 to rotate comprising a crank 20 driving the shaft 14 through a ratchet assembly 22.

In operation, one end of a strap is passed between the groove 32 and the tensioner bar 34 and wrapped slightly more than once around the shaft 14. This wrapping should retain the strap on the shaft 14 sufficiently to allow the strap to be rolled. The crank 20 then is rotated to cause the shaft 14 to rotate and roll the strap onto it. If necessary or desirable, the knurled knob 46 can be rotated to compress the tensioner bar 34 into the groove 32 so as to provide any necessary or desirable degree of tension while the strap is being rolled up. After the strap has been rolled, the strap can easily be slipped off the end of shaft 14. The ratchet assembly 22 prevents the strap from unrolling if the crank 20 is not retained in position, such as when the strap is being slipped off.

Although the invention has been described with respect to a particular preferred embodiment, it will be obvious to those skilled in the art that many changes and modifications can be made without departing from the spirit or scope of the invention. In particular, any conventional strap tensioning device, ratchet device and attachment device can be used. Similarly, any conventional means for rotating the shaft can be used. Accordingly, no limitations are to be implied or inferred except as specifically and explicitly set forth in the attached claims.

What is claimed is:

1. A device for rolling a strap, comprising:

a unitary shaft having a longitudinal axis, an arcuate outer surface and two outward facing substantially flattened sides extending substantially parallel to said axis and substantially perpendicular to each other;

rotating means for rotating said shaft in a rolling direction about said longitudinal axis, operatively connected to said shaft, whereby a strap wound around said shaft slightly more than once is retained on said shaft sufficiently that said strap can thereafter be rolled onto said shaft under tension by rotating said shaft in said rolling direction.

2. A device according to claim 1, further comprising:

a strap tensioner for placing said strap under tension as said strap is drawn through said tensioner, spaced apart from said shaft.

3. A device according to claim 2, wherein:

said strap defines a roll radius when it is rolled onto said shaft, said shaft and said strap tensioner define a roll space, and said roll space is greater than said roll radius.

4. A device according to claim 3, further comprising:

attachment means for attaching said device to a surface.

5. A device according to claim 4, wherein: said attachment means comprises a clamp.

6. A device according to claim 3, further comprising:

ratchet means operatively attached to said shaft for allowing rotation of said shaft in only said rolling direction.

7. A device according to claim 6, wherein:

said rotation means comprises a crank attached to said shaft.

8. A device according to claim 6, wherein:

said strap tensioner comprises:

a tensioner table having a groove formed thereon;

a tensioner bar configured to conform to said groove; and compression means for compressing said tensioner bar into said tensioner table and into said groove, operatively attached to said tensioner table and said tensioner bar.

9. A device according to claim 8, further comprising:

alignment means for maintaining said tensioner bar in alignment with said groove as said tensioner bar is compressed into said groove, connected to said tensioner bar.

10. A device according to claim 8, wherein:

said compression means comprises:

variable compression means for variably compressing said tensioner bar into said tensioner table.

11. A device according to claim 10, wherein: said variable compression means comprises:

a tensioner frame attached to said tensioner table and extending away from said tensioner table, said tensioner frame including a tensioner top having a threaded screw aperture;

a tension adjustment screw extending through said threaded screw aperture; and a spring mounted between said tension adjustment screw and said tensioner bar.

12. A device according to claim 11, wherein:

said tensioner frame has an alignment aperture formed therein, and said alignment means comprises:

an alignment rod attached to said tensioner bar and extending through said alignment aperture.

13. A method for using a unitary shaft having a longitudinal axis, an arcuate outer surface, two ends and two outwardly facing substantially flattened sides extending substantially parallel to the axis of said shaft and substantially perpendicular to each other, comprising:

wrapping a strap slightly more than once around said shaft, whereby said strap is retained on said shaft sufficiently that said strap can thereafter be rolled under tension by rotating said shaft in a rolling direction;

applying tension to said strap;

rolling said strap under said tension onto said shaft by rotating said shaft in said rolling direction to form a rolled strap; and sliding said rolled strap off one of said ends of said shaft after said rolling step without rolling said shaft in an unrolling direction opposite said rolling direction.

14. A method for rolling a strap, comprising:

providing a unitary shaft having a longitudinal axis, an arcuate outer surface, and two outwardly facing substantially flattened sides extending substantially parallel to said axis and substantially perpendicular to each other;

wrapping said strap slightly more than once around said shaft, whereby said strap is retained on said shaft sufficiently that said strap can thereafter be rolled by rotating said shaft in a rolling direction;

rotating said shaft in a rolling direction to roll said strap onto said shaft;

slipping said rolled strap off said shaft without rotating said shaft in an unrolling direction opposite said rolling direction.

15. A method according to claim 14, further comprising: applying tension to said strap during said rotating step.

16. A device for rolling a strap, comprising:

a frame;

a shaft support member attached to said frame;

a unitary shaft rotatably mounted on said shaft support member having a longitudinal axis, an arcuate outer surface and two outwardly facing substantially flattened sides extending substantially parallel to said axis and substantially perpendicular to each other;

a crank operatively attached to said shaft for rotating said shaft;

a ratchet operatively attached to said shaft for allowing rotation of said shaft in only a rolling direction;

a strap tensioner mounted on said frame for placing said strap under tension as said strap is drawn through said tensioner, spaced apart from said shaft, wherein said strap defines a roll radius when said strap is rolled onto said shaft, said shaft and said strap tensioner defining a roll space, said roll space being greater than said roll radius;

whereby wrapping said strap slightly more than once around said shaft retains said strap on said shaft sufficiently that said strap can thereafter be rolled under tension provided by said strap tensioner by rotating said shaft in said rolling direction; and a clamp attached to said frame for attaching said frame to a surface.

17. A device according to claim 16, wherein said strap tensioner comprises:

a tensioner table having a groove formed thereon;

a tensioner bar having a top and a bottom, said bottom being configured to conform to said groove;

an alignment bar attached to the top of said tensioner bar;

a tensioner frame attached to said tensioner table and extending above said alignment bar, said tensioner frame including a tensioner top having a threaded screw aperture and having two alignment apertures formed therein;

two alignment rods attached to said alignment bar and extending upwards through said alignment apertures, whereby said alignment rods maintain said alignment bar and said tensioner bar in alignment so that said bottom of said tensioner bar is positioned above said groove;

a tension adjustment screw extending through said threaded screw aperture and bearing against said alignment bar, whereby movement of said screw causes movement of said alignment bar and said compression bar;

two springs mounted between said alignment bar and said tensioner bar, whereby pressure on said alignment bar caused by said tension adjustment screw is springingly transmitted to said compression bar and urges said bottom of said compression bar into said groove.

18. A device for rolling a strap, comprising:

a unitary shaft having a longitudinal axis, and arcuate outer surface and two outwardly facing substantially flattened sides extending substantially parallel to said axis and substantially perpendicular to each other;

rotating means for rotating said shaft about said longitudinal axis, operatively connected to said shaft;

ratchet means operatively attached to said shaft for allowing rotation of said shaft in only a rolling direction;

strap tensioner means for placing said strap under tension as said strap is rolled onto said shaft, spaced apart from said shaft, wherein said strap defines a roll radius when said strap is rolled onto said shaft, wherein said shaft and said strap tensioner means define a roll space, and wherein said roll space is greater than said roll radius;

whereby wrapping said strap slightly more than once around said shaft retains said strap on said shaft sufficiently that said strap can thereafter be rolled by said rotating means under tension provided by said strap tensioner means by rotating said shaft in said rolling direction.

* * * * *